United States Patent [19]

Ahmed et al.

[11] 3,947,083

[45] Mar. 30, 1976

[54] EDGE CONTACT

[75] Inventors: Kamal Ahmed, Stanmore; Colin David Kindell, Bushey, both of England

[73] Assignee: AMP Incorporated, Harrisburg, Pa.

[22] Filed: Jan. 2, 1975

[21] Appl. No.: 538,235

[30] Foreign Application Priority Data

Jan. 26, 1974 United Kingdom ..... 3714/74

[52] U.S. Cl. ..... 339/258 P; 339/176 MP

[51] Int. Cl.[2] ..... H01R 11/22

[58] Field of Search ..... 339/17 R, 17 L, 17 LC, 339/176 MP, 217 S, 256, 258

[56] References Cited

UNITED STATES PATENTS 2,770,791 11/1956 Batcheller ..... 339/258 S 3,383,638 5/1968 Coldren ..... 339/17 R

FOREIGN PATENTS OR APPLICATIONS 1,113,856 5/1968 United Kingdom ..... 339/258 S

OTHER PUBLICATIONS

Snap–Lok Publication, National Connector Corp., received 1–1963.

*Primary Examiner*—Roy Lake
*Assistant Examiner*—Neil Abrams
*Attorney, Agent, or Firm*—William J. Keating; Frederick W. Raring; Jay L. Seitchik

[57] ABSTRACT

An electrical contact for use in a printed circuit board edge connector comprises a pair of channel cross-section arms each providing a pair of contact surfaces for engaging a board mated with the contact, the arms being relatively rigid and thus providing high contact pressures.

4 Claims, 2 Drawing Figures

EDGE CONTACT

This invention relates to an electrical contact for a printed circuit board edge connector.

Printed circuit board edge connectors are widely used and for certain application, for example in consumer goods such as washing machines, there is a requirement for such connectors having contacts which provide reliable connection under adverse conditions at low cost.

An electrical contact according to the present invention is formed from sheet metal and comprises a flat web from which extend a pair of spaced contact arms in forklike manner, each of the arms being of channel section, one of the channel section sides of each arm extending in generally coplanar manner from the flat web, and side portions of the channel sections distal of the flat web extending inwardly between the arms to define contact portions.

The contact of the invention is relatively cheap and easy to produce, and has the further advantages that due to the channel section form of the arms thereof, this making the arms relatively resistant to flexure, high contact pressures giving reliable electrical connections can be developed at the four contact portions of the arms.

The arms at the contact portion ends are suitably formed in the channel section bases with longitudinally extending slot open at the contact portion end and terminating short of the flat web.

The provision of such slots gives substantial independence of movement of the four contact portions, thus further ensuring reliable electrical connections with a mated printed circuit board.

The contact portions are suitably of arcuate form extending lengthwise of the arms and on sides distal of the flat web are suitably inclined outwardly at a shallow angle to define an enlarged entry to allow for easy insertion of a printed circuit board.

Figure 1:
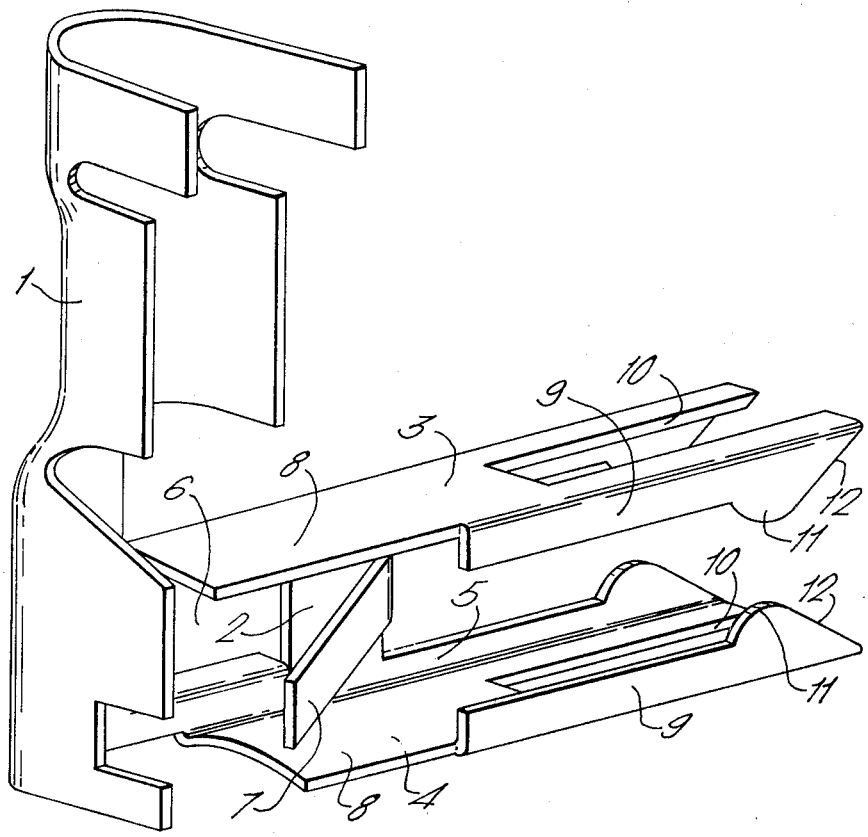
Figure 2:
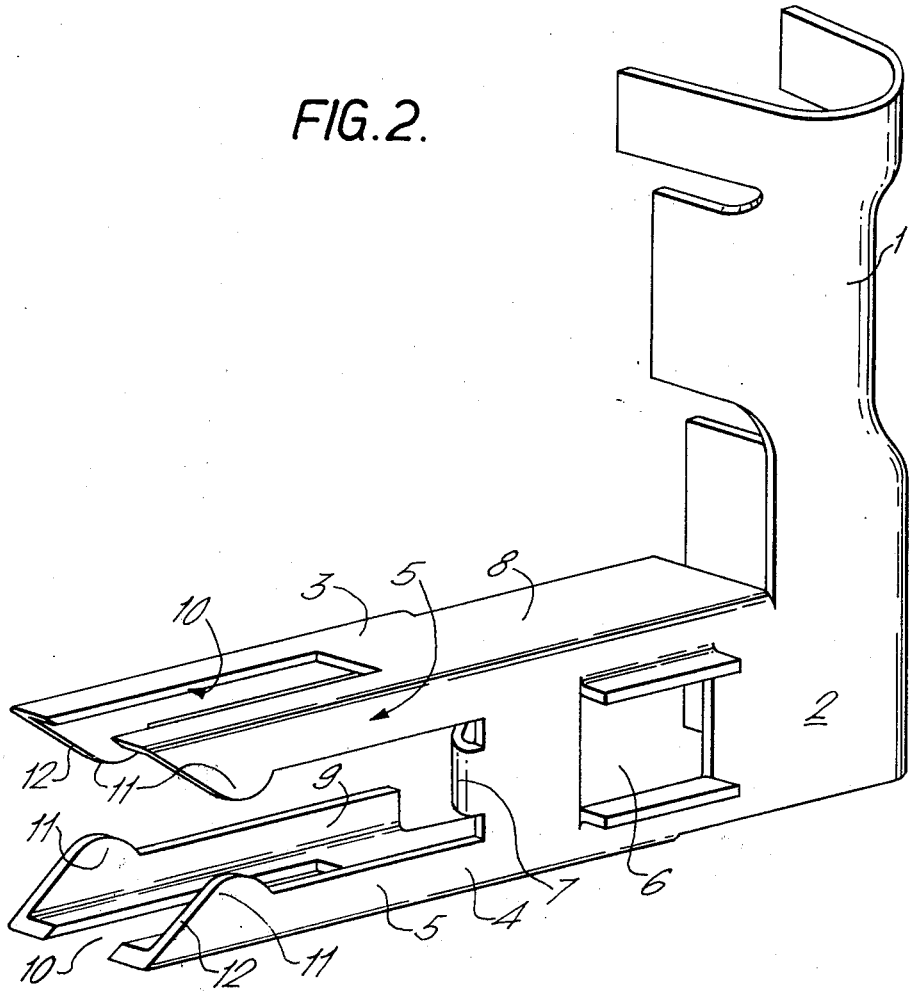

An embodiment of the invention will now be described by way of example with reference to the drawings in which FIG. 1 is a perspective view showing one side of the contact member;

FIG. 2 is a perspective view of the opposite side of the contact member.

Referring to the drawings, a crimping ferrule section 1 extends from a flat web portion 2 formed with a pair of parallel contact arms 3, 4. The contact arms are of similar form, each comprising a channel section of which one side 5 extends from the flat web in generally coplanar manner. The flat web portion 2 is formed between root parts of the arms with a flanged aperture 6, for mounting purposes, and at an edge between the aperture 6 and the side 5 of the arms 3 and 4, with a turned back tongue 7 for latching the contact in a housing.

The bases 8 of the channel sections of the arms 3 and 4 extend normally from the same side of the flat web portion 2 from the region of the aperture 6, and the tongue 7 is disposed between the channel bases 8.

The other side 9 of the channel sections of the arms 3 and 4 extend rearwardly from the free ends of the arms, and terminate short of the ends of the bases 8 approximately level with the forward edge of the flat web portion 2 between the arms 3 and 4.

The bases 8 of the channel sections are each formed with a slot 10 open at the free ends of the arms and extending towards but terminating short of the roots of the arms and the forward edge of the web portion 2 from which the tongue 7 extends. The sides 5, 9 of the channel sections adjacent the free ends of the arms 3 and 4 are formed with inwardly directed arcuate contact protuberances 11. Edges of these arcuate protuberances 11 extend tangentially at a shallow angle toward the free ends of the bases 8 to provide entry surfaces 12.

What is claimed is:

1. An electrical contactor, comprising a pair of spaced parallel opposed arms, said arms each having a planar section at the rear end thereof and having a channel shaped section at the front end with the sides of the channel shaped section of one arm extending toward the corresponding sides of the channel shaped section of the other arm, a planar web element adjacent the planar section and normal thereto connecting the side of the channel shaped section of one arm to the corresponding side of the channel shaped section of the other arm, the end of each arm distal of the web element having a longitudinal slot extending inwardly from the free end thereof intermediate the sides of the channel shaped sections, each of the sides of the channel shaped sections being provided adjacent the front end of each arm with a protruding contact portion extending towards that of the corresponding sides of the other channel shaped section, whereby the sides of the channel shaped sections of one arm are individually yieldable toward those of the other arm.

2. An electrical contactor according to claim 1 wherein the contact portions of the arms are of arcuate form, the corresponding sides of both channel shaped sections decreasing in height from the contact portions to the free ends of the arms to define an enlarged entry for a printed circuit board.

3. An electrical contactor according to claim 2 wherein a tongue member extends from the front edge of the web element at an angle thereto towards the rear end of the arm for latching the contactor in a housing.

4. An electrical contactor according to claim 3 including means connected to the web element for attaching the contactor to a conductor.

* * * * *